US012799641B2

(12) United States Patent
Yin

(10) Patent No.: US 12,799,641 B2
(45) Date of Patent: Nov. 17, 2026

(54) APPARATUS AND METHOD FOR IMPROVING YARN STRENGTH AND HAIRINESS IN SINGLES RING YARNS

(71) Applicant: North Carolina State University, Raleigh, NC (US)

(72) Inventor: Rong Yin, Raleigh, NC (US)

( * ) Notice: Subject to any disclaimer, the term of this patent is extended or adjusted under 35 U.S.C. 154(b) by 0 days.

(21) Appl. No.: 19/284,885

(22) Filed: Jul. 30, 2025

(65) Prior Publication Data

US 2026/0049419 A1 Feb. 19, 2026

Related U.S. Application Data

(60) Provisional application No. 63/682,492, filed on Aug. 13, 2024.

(51) Int. Cl.
*D01H 13/30* (2006.01)
*D01H 1/02* (2006.01)

(52) U.S. Cl.
CPC ..... *D01H 13/302* (2013.01); *D01H 1/02* (2013.01); *D10B 2201/01* (2013.01); *D10B 2401/063* (2013.01)

(58) Field of Classification Search
CPC ..... D01H 13/302
USPC ..... 57/298
See application file for complete search history.

(56) References Cited

U.S. PATENT DOCUMENTS 1,779,505 A * 10/1930 Van Der Jagt ..... D01B 9/00 57/298
1,867,664 A * 7/1932 Groves ..... D01H 13/306 57/295
1,940,749 A * 12/1933 Gwaltney ..... D01H 13/30 57/295
2,089,021 A * 8/1937 Foster ..... D02G 3/20 57/200
2,558,734 A * 7/1951 Cresswell ..... D01D 10/0436 68/19
2,581,566 A * 1/1952 Whitehead ..... D01D 10/0481 57/295
3,558,760 A * 1/1971 Olson ..... D02G 1/18 264/168
3,852,946 A * 12/1974 Smith ..... D02G 1/04 57/247

(Continued)

FOREIGN PATENT DOCUMENTS

CN 101736469 A * 6/2010 ..... D01H 1/02
CN 102051718 A 5/2011

(Continued)

OTHER PUBLICATIONS

"Convert Psi to Megapascal." Unit Converters. Feb. 5, 2026. https://www.unitconverters.net/pressure/psi-to-megapascal.htm (Year: 2026).*

*Primary Examiner* — Grace Huang
(74) *Attorney, Agent, or Firm* — Jennifer R. Knight

(57) ABSTRACT

The present invention provides a modified sustainable droplet-wet spinning technology aimed at enhancing hemp yarn quality. Implemented on a ring spinning machine, the technology delivers a controlled amount of water onto the top front roller which results in a more compact spinning triangle. The invention can be readily implemented on commercial ring spinning systems and improve both tenacity and hairiness of fibers comprising hemp.

16 Claims, 8 Drawing Sheets

(56) References Cited

U.S. PATENT DOCUMENTS

| | | | | | |
|---|---|---|---|---|---|
| 3,885,277 | A * | 5/1975 | Schutz | D06B 3/04 | 57/298 |
| 4,040,241 | A * | 8/1977 | Speranzin | D01H 13/306 | 57/296 |
| 4,114,357 | A * | 9/1978 | Greive | D01H 13/306 | 57/296 |
| 4,244,173 | A * | 1/1981 | Lulay | D02G 1/18 | 57/208 |
| 4,316,358 | A * | 2/1982 | Takai | D01H 1/11 | 57/286 |
| 4,430,406 | A * | 2/1984 | Newkirk | G03G 15/2057 | 430/124.38 |
| 5,262,099 | A * | 11/1993 | Adams | D01F 6/60 | 264/210.8 |
| 6,699,368 | B2 * | 3/2004 | Ishii | D21F 3/0227 | 428/167 |
| 6,716,256 | B2 * | 4/2004 | Umehara | D06M 11/54 | 57/254 |
| 6,926,772 | B2 * | 8/2005 | Leonard | B05C 11/021 | 118/235 |
| 7,571,524 | B2 * | 8/2009 | Kawabe | D02J 1/18 | 28/282 |
| 7,913,483 | B2 * | 3/2011 | Qiu | D02G 3/367 | 57/18 |
| 9,388,516 | B2 * | 7/2016 | Miyauchi | D02J 1/222 | |
| 10,161,066 | B2 * | 12/2018 | Yeung | D01H 1/025 | |
| 10,611,889 | B2 * | 4/2020 | Desbois | C08J 5/243 | |
| 10,851,479 | B2 | 12/2020 | Tao et al. | | |
| 11,866,849 | B2 * | 1/2024 | Bueno | B29B 7/726 | |
| 12,529,166 | B2 * | 1/2026 | Goto | D01F 6/70 | |
| 2013/0255217 | A1 * | 10/2013 | Tao | D01H 7/926 | 57/284 |
| 2024/0035217 | A1 * | 2/2024 | Cao | B32B 5/18 | |

FOREIGN PATENT DOCUMENTS

| | | | | | |
|---|---|---|---|---|---|
| CN | 202064063 | U | | 12/2011 | |
| CN | 203007531 | U | | 6/2013 | |
| CN | 103225147 | B | | 2/2016 | |
| CN | 104278369 | B | * | 9/2016 | D01H 7/923 |
| CN | 107604490 | A | * | 1/2018 | |
| EP | 0100192 | B1 | * | 1/1987 | D02G 3/367 |
| GB | 191013220 | A | * | 4/1911 | D02G 3/00 |
| JP | S60185824 | A | * | 9/1985 | D01H 1/115 |
| JP | 61063731 | A | * | 4/1986 | D01H 11/00 |
| JP | 01097206 | A | * | 4/1989 | D01D 10/00 |
| SU | 1359362 | A1 | * | 12/1987 | |
| WO | WO-2020222244 | A1 | * | 11/2020 | D03D 15/283 |

* cited by examiner

APPARATUS AND METHOD FOR IMPROVING YARN STRENGTH AND HAIRINESS IN SINGLES RING YARNS

CROSS-REFERENCE

This application claims the benefit of U.S. Provisional Patent Application Ser. No. 63/682,492 filed on Aug. 13, 2024, which is incorporated herein by reference in its entirety.

STATEMENT OF GOVERNMENT INTEREST

This invention was made with government support under grant number M6785421C6618 awarded by the United States Marine Corps. The government has certain rights in the invention.

TECHNICAL FIELD

The invention pertains to the production of more sustainable yarns. Specifically, the invention pertains to a method and apparatus for producing high-quality hemp-based yarns using available commercial equipment.

BACKGROUND

The textile and apparel industry, due to its energy-intensive processes, contributes to 6%-8% of the total global carbon emission. Throughout the textile lifecycle, factors such as fiber type, textile production stage, consumer use stage, and end-of-life significantly impact carbon emission. Notably, raw materials, yarn production, and dyeing and finishing stages are identified as major contributors to climate impact. In the fiber preparation stage, natural fibers offer advantages such as biodegradability and the absence of microplastics and additives when landfilled. However, assessments reveal that the environmental impact of natural fibers is considerable due to the extensive water usage, reliance on toxic pesticides, and fertilizers during cultivation. For instance, cotton, representing a quarter of the world's textile fibers, demands substantial irrigation water, energy, pesticides, fertilizers, and land, posing significant environmental challenges. Within the textile production stage, yarn manufacturing emerges as the most significant contributor to the overall carbon footprint, comprising 36.1%-50.5%. Therefore, mitigating the high environmental impact of the textile industry involves utilizing more eco-friendly raw materials to reduce the carbon footprint and adopting green technologies in textile production to decrease energy consumption, particularly within the energy-intensive yarn production stage, through the development of advanced spinning technologies with higher production efficiency.

Increasingly, the selection of eco-friendly fibers has favored hemp as a sustainable alternative. Compared to cotton, hemp requires less than one-third of the water for growth and occupies only half the land. Moreover, it boasts a shorter growth cycle and does not necessitate the use of pesticides, resulting in minimal environmental impact. Evaluation results indicate that the climate impact per kilogram of cotton fiber falls within the range of 0.5 to 4 kilograms of carbon dioxide, whereas for hemp fiber, this impact ranges from 0 to 3.6 kilogram. Furthermore, the growth phase of hemp crops contributes to soil health enhancement and converts atmospheric carbon dioxide into biomass. As for hemp textiles, they exhibit superior moisture-wicking capabilities, breathability, and natural antimicrobial properties, finding application in various products including clothing, bags, socks, and shoes. In 2018, the legalization of hemp production in the United States marked a significant milestone, with the total utilization of U.S. hemp fiber reaching over 12.5 million kilograms. It is anticipated that the hemp production in the United States will continue to grow in the coming years, positioning hemp as a potential material for textile use. Fashion brands such as Patagonia, Lee, and Wrangler are adopting hemp to advance their pursuit of sustainable development. However, the development of hemp textiles currently faces certain challenges, such as the uneven strength and diameter of hemp fibers after degumming, as well as the difficulty in textile processing due to their hardness and brittleness. These result in spun yarns with excessive hairiness, fabrics with a rough hand feel, and increased defects, contributing to hemp textiles' relatively lower market share compared to cotton. Therefore, fully maximizing the advantages of hemp fibers to produce high-quality hemp yarns and fabrics is a significant issue to be addressed Ring spinning is the dominant spinning technology in the yarn manufacturing industry a capacity of 233 million ring spindles around the world. There is a need to improve the strength and the hairiness of yarns made on ring spinning apparatus, and to do so at minimum cost. The need for improved strength and hairiness is especially applicable to yarns containing hemp fiber. Cost can be minimized by reducing capital expenditures and/or production costs such as energy usage. There is a need to precisely control the amount of liquid (e.g., water) added to the fibers to impact yarn quality and ensure that excess fluid does not cause operating problems such as machine damage. There is a need to improve spinning without increasing to the energy consumption. There is a need for a method of improved spinning that can be readily incorporated into current commercial ring spinning processes at low cost and with minimal space requirements.

SUMMARY

In some aspects, the techniques described herein relate to a method of producing yarn, the method including: adding a liquid to a roving fiber directly before a nip in front rollers or on a top front roller of a ring spinning apparatus to produce a liquid-exposed roving fiber. The liquid-exposed roving fiber produces a liquid-impacted spinning triangle of the roving fiber leaving the front rollers.

In some aspects, the techniques described herein relate to a method of producing yarn, the method including: adding a liquid to a roving fiber directly before a nip in front rollers or on a top front roller of a ring spinning apparatus to produce a liquid-exposed roving fiber. The liquid-exposed roving fiber produces a liquid-impacted spinning triangle of the roving fiber leaving the front rollers. The roving fiber includes cotton and/or hemp, and a twist multiplier level ranges from 2.5 to 5.5. The primary yarn product produced from the liquid-exposed roving fiber has a tenacity at least 5% higher than the tenacity of a comparison yarn product.

In some aspects, the techniques described herein relate to a system for producing an improved ring spun yarn, the system including: a ring spinning apparatus modified with a liquid distribution system. The liquid distribution system includes: (a) a nozzle proximate to a top of a front roller or proximate a nip at an entrance of front rollers; (b) a storage compartment capable of holding a liquid; (c) a pump; (d) a pipage system; and (e) a valve proximate to the nozzle. The pipage system includes the nozzle, and the valve. The pump includes a pump inlet and a pump outlet. The pump inlet is in fluid communication with the storage compartment and the pump outlet is in fluid communication with the pipage system. The liquid distribution system is capable of imparting the liquid onto a top of front rollers or onto a roving fiber proximate a nip at an entrance of the front rollers.

BRIEF DESCRIPTION OF THE DRAWINGS

The present disclosure is illustrated and described herein with reference to the various drawings, in which like reference numbers are used to denote like system components/method steps, as appropriate, and in which:

FIG. 7(*b*) is a schematic of a top view of the front roller showing the spinning triangle for a modified ring spinning system with water fed in the drafting section before the front rollers;

DETAILED DESCRIPTION

Figure 1:
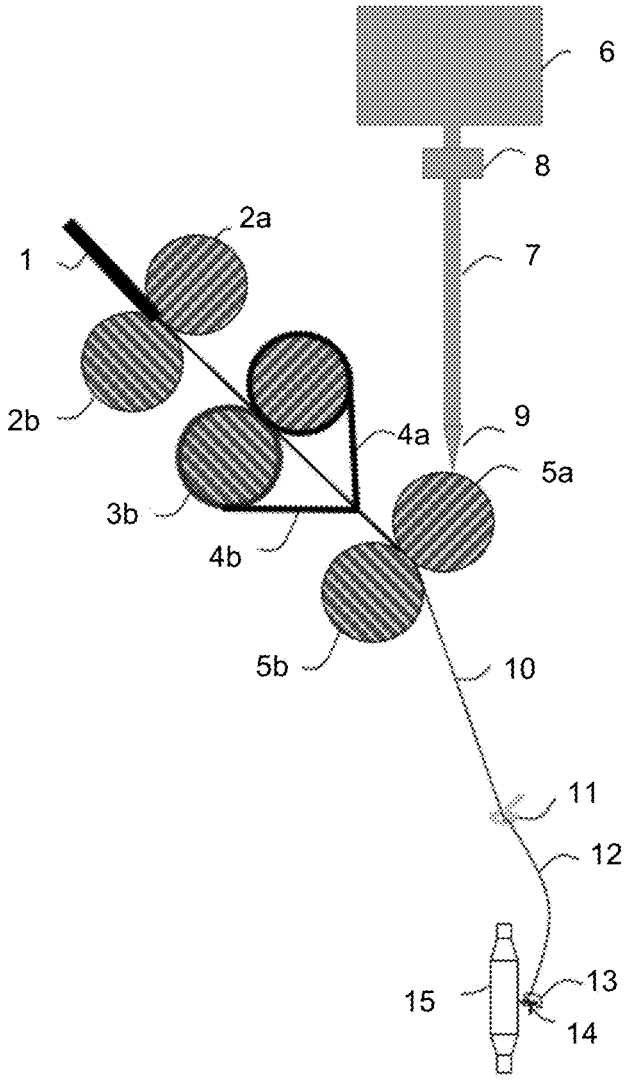
FIG. 1 is a schematic of a side view of a non-limiting embodiment of a ring spinning system modified for droplet-wet spinning with water added near the top front roller.

In some aspects, the techniques described herein relate to a method of producing yarn, the method including: adding a liquid to a roving fiber directly before a nip in front rollers or on a top front roller of a ring spinning apparatus to produce a liquid-exposed roving fiber. The liquid-exposed roving fiber produces a liquid-impacted spinning triangle of the roving fiber leaving the front rollers.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

It is to be understood that the mention of one or more method steps does not preclude the presence of additional method steps before or after the combined recited steps or intervening method steps between those steps expressly identified. Moreover, the lettering of method steps or ingredients is a conventional means for identifying discrete activities or ingredients and the recited lettering can be arranged in any sequence, unless otherwise indicated.

As used herein, the term "and/or", when used in a list of two or more items, means that any one of the listed items can be employed by itself, or any combination of two or more of the listed items can be employed. For example, if a composition is described as containing compounds A, B, "and/or" C, the composition may contain A alone; B alone; C alone; A and B in combination; A and C in combination; B and C in combination; or A, B, and C in combination.

As used herein, the term "ring spinning apparatus" refers to the predominant equipment for converting raw fibers of a material, such as cotton, into yarn. "Ring spinning apparatus" includes a drafting system, with a series of paired, top and bottom rollers including at least back rollers into which the roving is fed and front rollers from which the roving fiber leaves the drafting zone. The roving fiber gets twisted after leaving the front rollers. Then, the yarn threads through the yarn guide and the traveler. Finally, the yarn is wound onto a bobbin mounted on a driven spindle. In the process each rotation of the traveler on the spinning ring produces a twist in the yarn.

As used herein, the term "primary yarn product" refers to the yarn product made on the ring spinning apparatus with the addition of liquid. As used herein the term "comparison yarn product" refers to a yarn made of the same material (i.e., same composition) and in the same manner (i.e., on the same ring spinning apparatus under the same operating conditions) as the primary yarn product with the exception that no liquid was added. As used herein, term "high-twist yarn product" refers to a "comparison yarn product" at a higher twist multiplier than the "primary yarn product."

FIG. 1 is a schematic of a side view of a non-limiting embodiment of a ring spinning system modified for droplet-wet spinning with water added near the top front roller 5*a*. The roving 1 (the precursor to the yarn 10) is fed into a drafting system, including three driven, bottom rollers 2*b*, 3*b* and bottom front roller 5*b* with top rollers 2*a*, 3*a* and top front roller 5*a* positioned above them. The main drafting zone is provided with a guide unit consisting of rotating bottom and top aprons 4*a* and 4*b*. Water tank 6 is installed on top of the drafting zone. Nozzle 9 is placed near the top of the top front roller 5*a*. The nozzle 9 is connected to the water tank 6 by waterpipe 7. And the flow rate through the nozzle 9 is controlled by the flow valve 8. The liquid is passed from the top front roller 5*a* to the roving fiber in the drafting zone. The wetted roving fiber gets twisted after passing through the front rollers 5*a* and 5*b*. Then, the yarn 10 threads through the yarn guide 11 and then forms a spinning balloon 12 between the yarn guide 11 and the traveler 13. Finally, the yarn 10 is wound onto a bobbin 15 mounted on a driven spindle. In the process each rotation of the traveler 13 on the spinning ring 14 produces a twist in the yarn 10.

Figure 2:
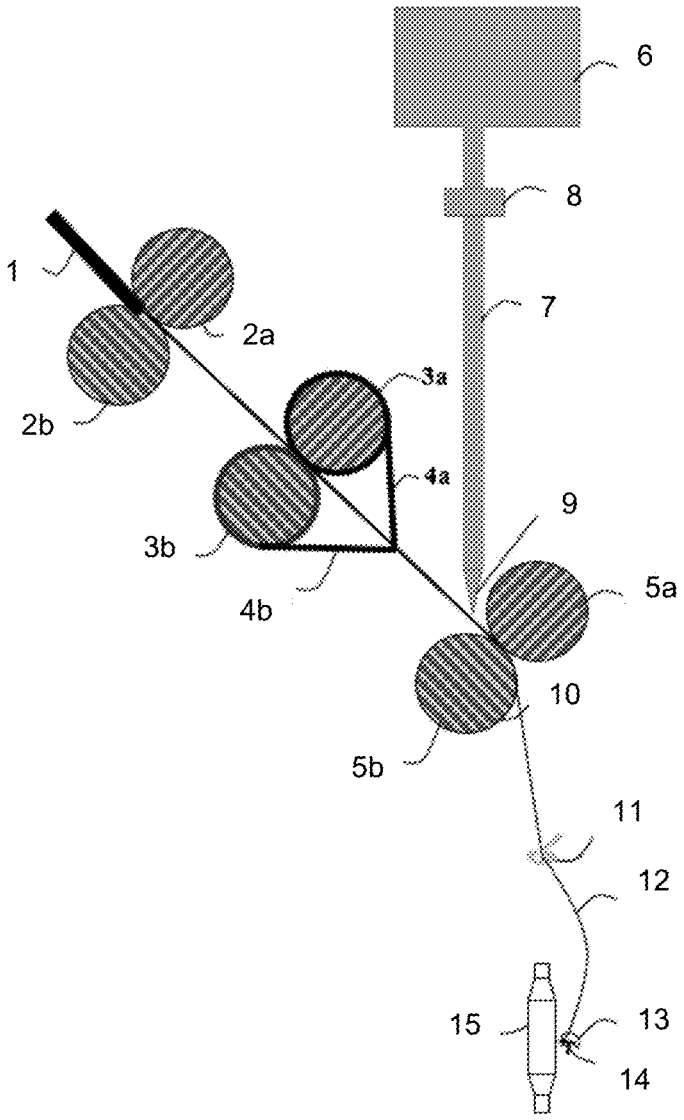
FIG. 2 is a schematic of a side view of another non-limiting embodiment of a ring spinning system modified for droplet-wet spinning with water added in the drafting zone before the front rollers.

FIG. 2 shows a schematic side view of another embodiment of the invention. In FIG. 2, the water is added to the roving fiber before entering the nip formed by top front roller 5*a* and bottom front roller 5*b*. The roving 1 (the precursor to the yarn 10) is fed into a drafting system, including three driven, bottom rollers 2*b*, 3*b* and 5*b* with top rollers 2*a*, 3*a* and 5*a* positioned above them. The main drafting zone is provided with a guide unit consisting of rotating bottom and top aprons 4*a* and 4*b*. Water tank 6 is installed on top of the drafting zone. Nozzle 9 is placed above the fibers proximate the front rollers 5*a* and 5*b*. The nozzle 9 is connected to the water tank 6 by waterpipe 7. And the flow rate through the nozzle 9 is controlled by the flow valve 8. The wetted roving fiber gets twisted after passing through the front rollers 5*a* and 5*b*. Then, the yarn 10 threads through the yarn guide 11 and then forms a spinning balloon 12 between the yarn guide 11 and the traveler 13. Finally, the yarn 10 is wound onto a bobbin 15 mounted on a driven spindle. In the process each rotation of the traveler 13 on the spinning ring 14 produces a twist in the yarn.

For simplicity, the embodiments of FIG. 1 and FIG. 2 show a water tank 6 above the front rollers with a pipe 7 and a valve 8 between the water tank 6 and the nozzle 9. The drawing depict the lab-scale operating unit, consisting of a syringe pump (not shown) and a small-diameter water pipe. The unit allowed for precise control of water volume which was suitable for laboratory-scale research. However, it was limited to supporting only up to six spinning units and required frequent manual refilling due to the small capacity of the syringes. Additionally, the rigid tubing and external structural supports necessitated frequent manual adjustments, further reducing operational efficiency. Scaling this system to commercial levels—where hundreds or thousands of spinning units are used—would be cost-prohibitive due to the high equipment and maintenance requirements per position.

To overcome these challenges, in some aspects, the present invention utilizes a high-flow peristaltic pump capable of delivering up to approximately 1,500 mL/min of water. This system is designed to support up to 2,000 spinning units simultaneously. The water is distributed through a modular network composed of standard commercial components, including flexible plastic water tubing, T-connectors, Y-splitters, and tube fittings. The use of flexible, adjustable plastic hoses allows for rapid system configuration and easy flow branching with minimal structural support. This design ensures consistent and continuous water droplet delivery across all spinning positions without the need for frequent refills or manual realignment. This embodiment significantly reduces the per-unit cost and enhances the scalability of the droplet application process, making it suitable for industrial-scale spinning operations.

Figure 3:
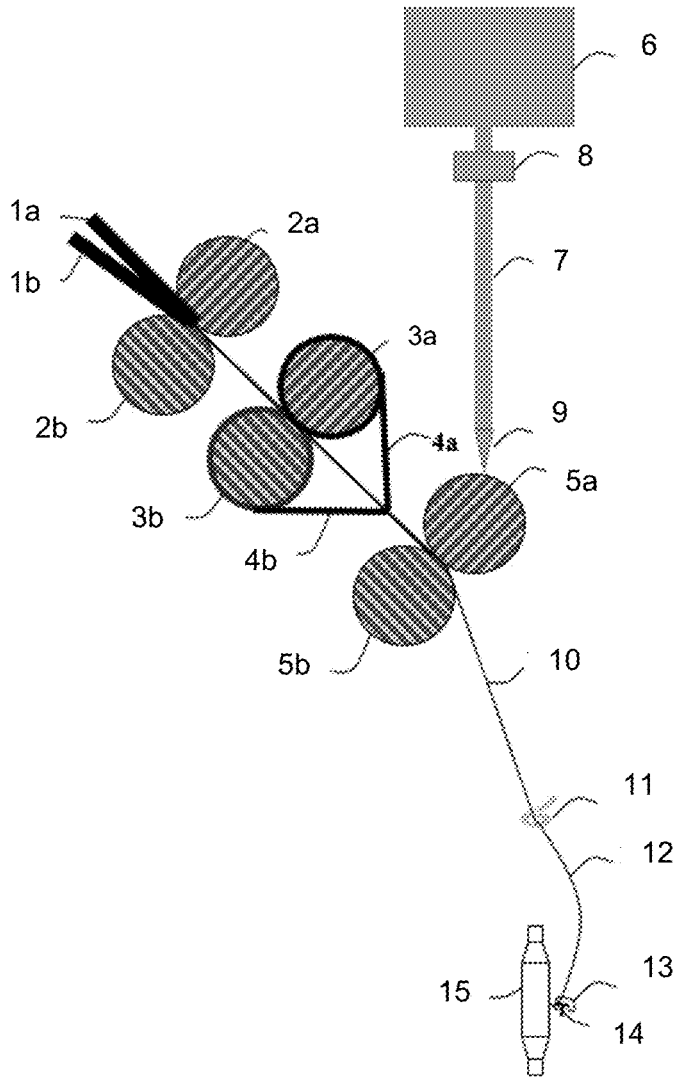
FIG. 3 is a schematic of a side view of a non-limiting embodiment of a ring spinning system modified for droplet-wet spinning with water added near the top front roller and with two rovings being fed to the back rollers.
Figure 4:
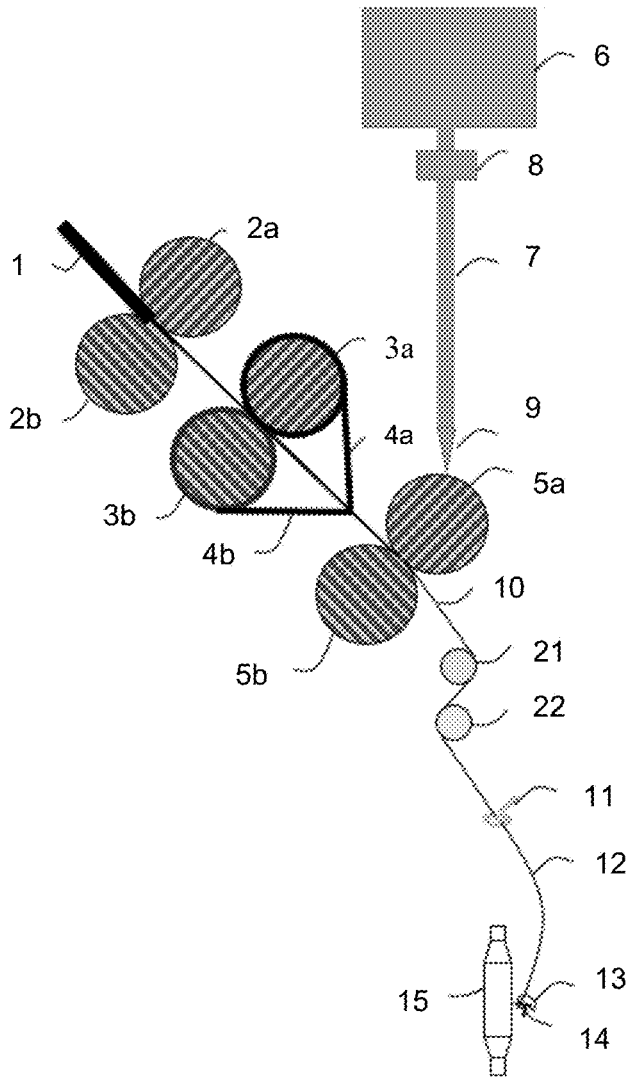
FIG. 4 is a schematic of a side view of another non-limiting embodiment of a Siro-spun spinning system modified for droplet-wet spinning with water added near the top front roller and with two belts placed between the front roller and the yarn guide.
Figure 5:
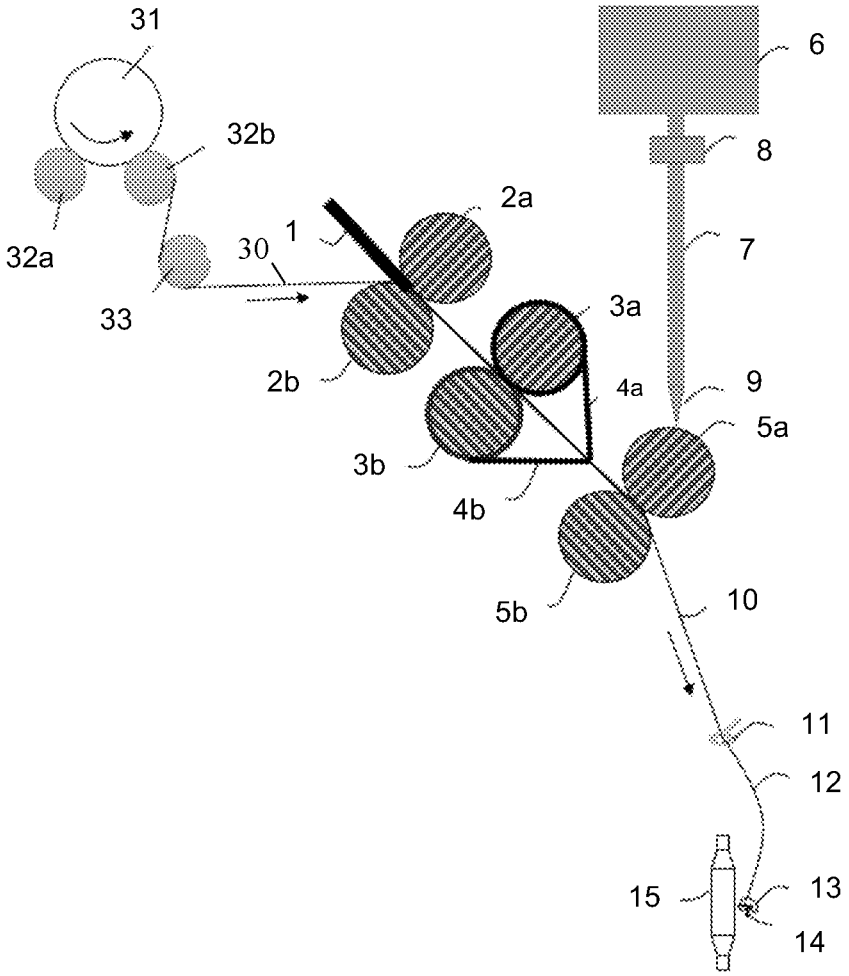
FIG. 5 is a schematic of a side view of another non-limiting embodiment of a Siro-spun spinning system modified for droplet-wet spinning with water added near the top front roller and with core spandex/filament added at the back rollers.
Figure 6:
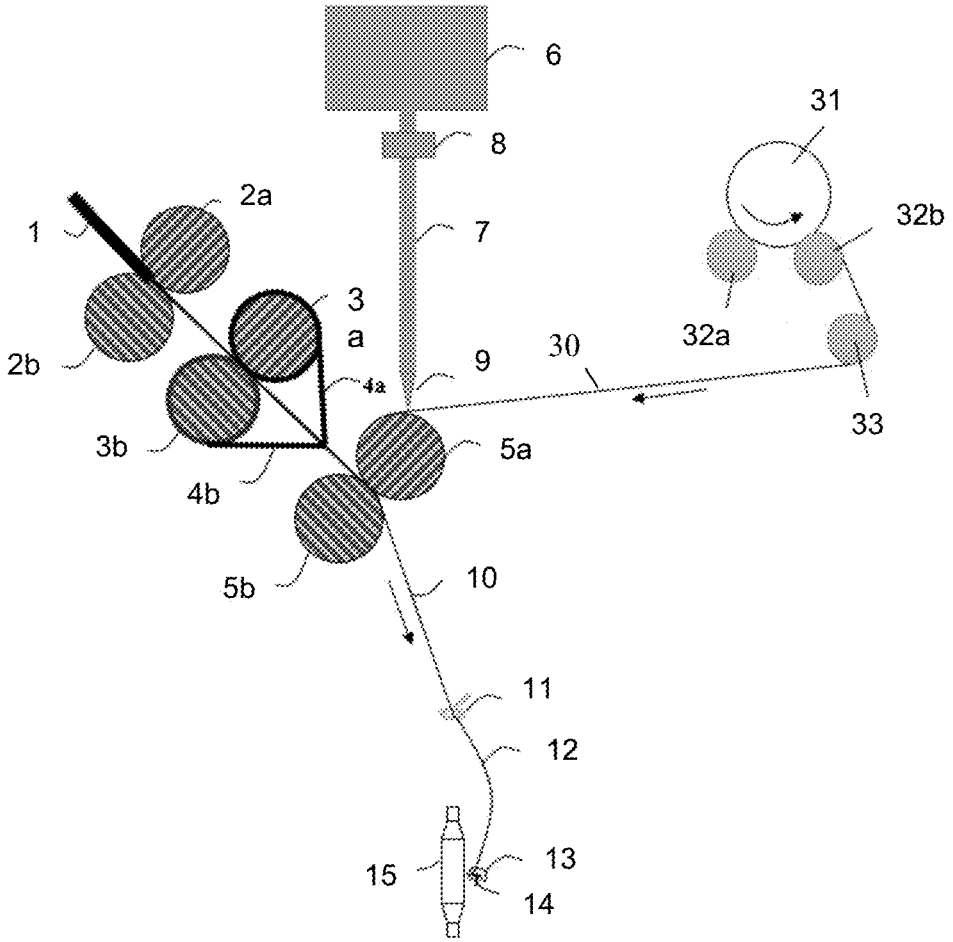
FIG. 6 is a schematic of a side view of another non-limiting embodiment of a Siro-spun spinning system modified for droplet-wet spinning with water added near the top front roller and with core spandex/filament added at the front rollers.

FIG. 3 shows a schematic side view of the nonlimiting embodiment of FIG. 1 with the addition of two rovings 1*a* and 1*b* to the back rollers. FIG. 4 shows a schematic side view of the non-limiting embodiment of FIG. 1 and the additional modification of two belts 21 and 22 placed between the front rollers 5*a* and 5*b* and the yarn guide 11. FIG. 5 shows a schematic side view of the non-limiting embodiment of FIG. 1 with the addition of a spandex/filament 30 into the back rollers 2*a* and 2*b*, The package of spandex/filament 31 is unwound by rollers 32*a* and 32*b* which are used to control the unwinder speed, and guide roller 33 is used to deliver the unwound spandex/filament 30 at a controlled speed and also add tension onto the spandex/filament 30. FIG. 6 shows a schematic side view of the non-limiting embodiment of FIG. 1 with the addition of a spandex/filament 30 into the front rollers 5*a* and 5*b*.

Figure 7A:
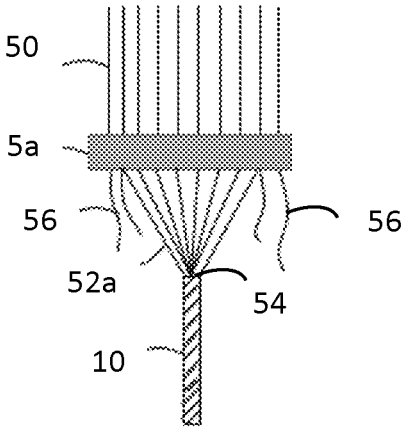
Prior Art FIG. 7(a)
FIG. 7(*a*) is a schematic of a top view of the front roller showing the spinning triangle for a conventional ring spinning system.
Figure 7B:
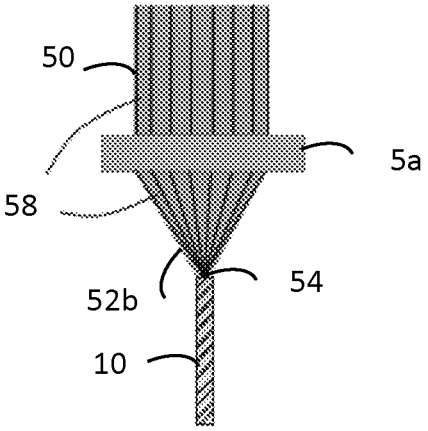

FIG. 7(*a*) is a top view schematic of a conventional ring spinning operation showing roving fiber 50 going between the top front roller 5*a* and the bottom front roller (not shown). It shows the spinning triangle 52*a*, which is the area between where the roving fiber 50 that has passed under the top front roller 5*a*, and the twist convergence point 54. FIG. 7(*a*) also shows loose fibers 56 which cause the yarn to display hairiness. FIG. 7(*b*) is a top view schematic of a non-limiting embodiment of the droplet-wet spinning invention where a water line (not shown) proximate to the top front roller 5*a* disperses water to the roving fiber 50 right before it reaches the top front roller 5*a* (the system shown in FIG. 2). The effect of adding water is to cause the roving fiber 50 to converge toward the center, making the spinning triangle 52*b*, using droplet-wet spinning, more compact than the spinning triangle 52*a*, using conventional ring spinning. The area of moisture 58 includes the roving fiber 50 immediately before the top front roller 5*a* and the fiber triangle 52*b*.

In some aspects, a method of producing yarn comprises adding a liquid to a roving fiber directly before a nip in front rollers or on a top front roller of a ring spinning apparatus to produce a liquid-exposed roving fiber. In some aspects, the liquid-exposed roving fiber produces a liquid-impacted spinning triangle of the roving fiber leaving the front rollers. In some aspects, the liquid-impacted spinning triangle is more compact than a dry spinning triangle of the yarn made from the roving fiber without adding the liquid.

In some aspects, the roving fiber comprises a hydrophilic fiber. In some aspects, the roving fiber comprises cotton, bamboo, linen, hemp, viscose, rayon, modal, Tencel and/or wool. In some aspects, the roving fiber comprises from 0 wt. % to 100 wt. %; cotton and from 0 wt. % to 50 wt. % hemp. In some aspects the roving fiber comprises from 0 wt. % to 100 wt. % cotton and from 0 wt. % to 100 wt. % hemp.

The composition of the liquid is not particularly limited as long as it is compatible with the roving fiber and downstream processing. In some aspects, liquid comprises water, ethyl alcohol, soap, sodium carboxymethyl cellulose, polyacrylamide, and/or polyvinyl alcohol. In some aspects, the liquid comprises water. In some aspects, a temperature of the liquid ranges from 20° C. to 90° C.; or from 20° C. to 80° C.; or from 20° C. to 70° C.; or from 20° C. to 60° C.; or from 20° C. to 50° C.; or from 20° C. to 40° C.; or from 20° C. to 30° C.

In some aspects, the liquid is added at a flowrate ranging between 0.01 l/hr. and 1 l/hr.; or between 0.01 l/hr. and 0.75 l/hr.; or between 0.01 and 0.5 l/hr.; or between 0.01 l/hr. and 0.25 l/hr.; or between 0.05/hr. and 1 l/hr.; or between 0.05 l/hr. and 0.75 l/hr.; or between 0.05 and 0.5 l/hr.; or between 0.05 l/hr. and 0.25 l/hr. In some aspects, the method further comprises measuring a speed of one of the front rollers and adjusting the flowrate of the liquid. In some aspects, the liquid is added through a nozzle and the nozzle has a pressure ranging from 0.1 MPa to 3 MPa.

In some aspects, the method further comprises an addition of a filament to the ring spinning apparatus at the back rollers or the front rollers. In some aspects the filament comprises spandex.

In some aspects, a twist multiplier level ranges from 2.5 to 5.5, or from 2.5 to 5.0, or from 2.5 to 4.7, or from 2.5 to 4.4, or from 2.5 to 4.0, or from 3.0 to 5.5, or from 3.0 to 5.0, or from 3.0 to 4.7, or from 3.0 to 4.4, or from 3.5 to 5.5, or from 3.5 to 5.0, or from 3.5 to 4.7, or from 3.5 to 4.4, or from 3.3 to 4.4.

The present inventive method of producing yarn, produces a primary yarn product that has improved properties over a comparison yarn product made without adding a liquid to the roving fiber. In some aspects the primary yarn product produced from the liquid-exposed roving fiber has a tenacity at least 5% or at least 10% or at least 15% higher than the tenacity the comparison yarn product. In some aspects, a primary product produced from the liquid-exposed roving fiber at a twist multiplier of 3.6 has a tenacity at least as large as a high-twist yarn product produced at a twist multiplier of 4.0 or 4.2 or 4.4 and without adding a liquid to the roving fiber.

In some aspects the primary yarn product produced from the liquid-exposed roving fiber has a hairiness value at least 25% or at least 30% or at least 40%, or at least 45% lower than the hairiness value of a comparison yarn product produced without adding a liquid to the roving fiber.

In some aspects, the techniques described herein relate to a method of producing yarn, the method including: adding a liquid to a roving fiber directly before a nip in front rollers or on a top front roller of a ring spinning apparatus to produce a liquid-exposed roving fiber. The liquid-exposed roving fiber produces a liquid-impacted spinning triangle of the roving fiber leaving the front rollers. The roving fiber includes cotton and/or hemp, and a twist multiplier level ranges from 3.6 to 4.4. The primary yarn product produced from the liquid-exposed roving fiber has a tenacity at least 5% or at least 10% or at least 15% higher than the tenacity of a comparison yarn product.

In some aspects, the liquid comprises water. In some aspects, the liquid is added at a flowrate, given in liter/hour (l/hr), ranging between 0.01 l/hr. and 1 l/hr.; or between 0.01 l/hr. and 0.75 l/hr.; or between 0.01 and 0.5 l/hr.; or between 0.01 l/hr. and 0.25 l/hr.; or between 0.05 l/hr. and 1 l/hr.; or between 0.05 l/hr. and 0.75 l/hr.; or between 0.05 and 0.5 l/hr.; or between 0.05 l/hr. and 0.25 l/hr. In some aspects, the method further comprises measuring a speed of one of the front rollers and adjusting the flowrate of the liquid.

In some aspects, the liquid is added through a nozzle and the nozzle has a pressure ranging from 0.1 MPa to 3 MPa. In some aspects, a temperature of the liquid ranges from 20° C. to 90° C.; or from 20° C. to 80° C.; or from 20° C. to 70° C.; or from 20° C. to 60° C.; or from 20° C. to 50° C.; or from 20° C. to 40° C.; or from 20° C. to 90° C.

In some aspects, the method further comprises: an addition of a filament to the ring spinning apparatus at a back rollers or the front rollers. In some aspects, the filament comprises spandex.

In some aspects, a primary product produced from the liquid-exposed roving fiber at a twist multiplier of 3.6 has a tenacity at least as large as a high-twist yarn product produced at a twist multiplier of 4.0 or 4.2 or 4.4 and without adding the liquid to the roving fiber.

In some aspects a primary yarn product produced from the liquid-exposed roving fiber has a hairiness value at least 25% or at least 30% or at least 40%, or at least 45% lower than the hairiness value of a comparison yarn product produced without adding the liquid.

In some aspects, the techniques described herein relate to a system for producing an improved ring spun yarn, the system including: a ring spinning apparatus modified with a liquid distribution system. The liquid distribution system includes: (a) a nozzle proximate to a top of a front roller or proximate a nip at an entrance of front rollers; (b) a storage compartment capable of holding a liquid; (c) a pump; (d) a pipage system; and (e) a valve proximate to the nozzle. The pipage system includes the nozzle, and the valve. The pump includes a pump inlet and a pump outlet. The pump inlet is in fluid communication with the storage compartment and the pump outlet is in fluid communication with the pipage system. The liquid distribution system is capable of imparting the liquid onto a top of front rollers or onto a roving fiber proximate a nip at an entrance of the front rollers.

In some aspects, the system further comprises: (f) a speed sensor capable of measuring a rotational speed of one of the front rollers; and (g) a control system capable of manipulating the valve for regulating of a flowrate of the liquid. In some aspects, regulating of the flowrate is informed by the measuring of the rotational speed.

In some aspects, the pipage system comprises flexible plastic tubing, T-connectors, Y-splitters, and tube fittings.

In some aspects, the pump is a high-flow peristaltic pump, and the pump is capable of delivering up to 1,500 mL/min of liquid to the pipage system for delivery onto the top front roller or onto a roving fiber proximate the nip of the entrance of the front rollers.

In some aspects, the liquid distribution system is capable of simultaneously supplying the liquid to up to 500 spinning units, or up to 1,000 spinning units, or up to 2,000 spinning units.

The various aspect of the liquid composition, liquid flowrate, liquid temperature, nozzle pressure, twist multiplier levels, and improved yarn qualities of tenacity and hairiness described above can be utilized with the system for producing an improved ring spun yarn.

EXAMPLES

For all spinning Examples, three bobbins of yarn were spun on three different spindles for measurement. Two pieces of knitted fabrics were produced using conventional ring-spun yarns and optimized droplet-wet spun yarns. All yarn and fabric samples were kept under standard laboratory conditions (20° C.±2° C., 65% relative humidity±2%) for at least 24 hours. Yarn tenacity, hairiness, evenness, and imperfections are essential properties of the yarn. Yarn tenacity was evaluated according to ASTM D2256 standard method using the Uster Tensorapid 4, with 20 subtests for each sample at a testing length of 250 mm and a testing speed of 300 mm/min. Yarn hairiness, evenness and imperfections were tested by the Uster Tester 5 following ASTM D1425 standard method, with each sample measured at a testing speed of 400 m/min for 1 minute.

Fabric quality assessment included evaluation of fabric weight, thickness, density, bursting strength, and pilling resistance. Fabric weight was determined by cutting 0.01 $m^2$ samples using a square cutter and subsequently weighing them on a laboratory scale. Three specimens were measured for each fabric sample to ensure accuracy. Fabric thickness was measured using a Feather touch thickness tester, with three specimens measured for each fabric sample. Fabric density was determined by counting the number of courses and wales per 5 centimeters. Bursting strength of the fabric was measured according to ASTM 3787 standards using a bursting strength tester. Five specimens were punctured by the tester for each fabric sample. Fabric pilling resistance was evaluated using the Maxi Martindale 1609 Abrasion Tester following ASTM D4970 standards, utilizing the fabric pilling evaluation apparatus for grading. Three specimens of each fabric were rubbed 3,000 times under a pressure of 9 kPa. Additionally, yarn and fabric surface morphologies were examined using scanning electron microscopy (SEM) (Hitachi TM4000II) operating at 5 kV.

In Examples 1-4, all Ne 32 single hemp/cotton blend yarns and cotton yarn were spun on a commercial sample ring spinning machine without and with the help of DWS (droplet-wet spinning). The raw hemp and cotton fibers were provided by Parkdale Mills. Fiber diameter was determined through SEM images accompanied with the software Image J, and fiber bundle strength was tested by a Pressley Fiber Bundle Strength Tester.

Figure 8A:
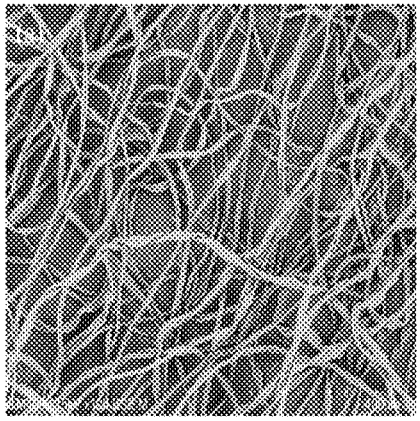
FIG. 8(*a*) is a scanning electron micrograph of cotton fibers and FIG. 8(*b*) is a scanning electron micrograph of hemp fibers.
Figure 8B:
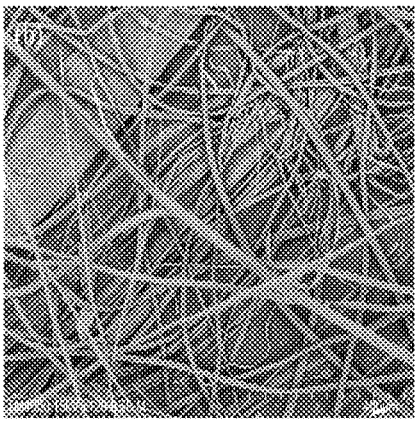

The fiber properties are detailed in Table 1 and the fiber surface morphologies for cotton and hemp are shown in FIG. 8(*a*) and FIG. 8(*b*), respectively. Combining the results of fiber diameter testing and fiber surface morphology, it is evident that cotton fibers exhibit a more uniform and finer diameter, displaying a curly structure. In contrast, hemp fibers demonstrate significant variations in diameter, as the coefficient of variation (cv %) is greater than 99. The larger cv % is partly due to residual pectin during processing, which leads to fiber aggregation and the formation of coarse fibers. Moreover, the presence of ultra-fine individual fibers results from machine combing during hemp processing. Strength testing reveals that hemp fiber bundles exhibit an average strength approximately 36% higher than that of cotton fiber bundles. The carded hemp/cotton blend rovings of 540 tex were processed in the spinning lab at North Carolina State University. In the spinning process, the spindle speed and total draft ratio were maintained at 8000 rpm and 29, respectively.

TABLE 1

Specifications of hemp and cotton fiber

| Items | Mean |
|---|---|
| Hemp fiber diameter (um) | 28.81 |
| [cv %] | [99.33] |
| Cotton fiber diameter (um) | 16.79 |
| [cv %] | [21.31] |
| Hemp fiber bundle strength (cN/tex) | 39.86 |
| [cv %] | [9.68] |
| Cotton fiber bundle strength (cN/tex) | 25.42 |
| [cv %] | [5.55] |

Example 1—Screening Water Flowrates

In the preliminary feasibility experiments, water droplet rates ranging from 0.2 ml per minute to 1.4 ml per minute were tested at 0.2 ml per minute intervals. At a water droplet rate of 0.2 ml per minute, the surface of the top front roller was inadequately covered with water, resulting in uneven wetting. Some fibers within the drafted fiber bundles adhered to the surface, impeding their entry into the spinning triangle, thereby causing fiber loss and disrupting continuous spinning. Conversely, at a water droplet rate of 1.4 ml per minute, excessive water failed to adhere to the top front roller surface, leading to dripping onto the ring spinning machine. This could potentially cause long-term damage to the machine and result in water wastage. Therefore, for this study, the water droplet rate was confined within the range of 0.4 ml per minute to 1.2 ml per minute.

Example 2—Effect of Water Droplet Rate on Yarn Quality

Figure 9A:
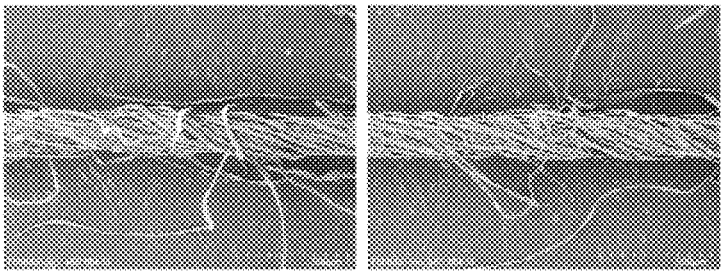
Prior Art FIG. 9(a)
FIG. 9(*a*) are scanning electron micrographs of a conventional ring-spun yarn and FIG. 9(*b*) are scanning electron micrographs of a droplet wet spun yarn.
Figure 9B:
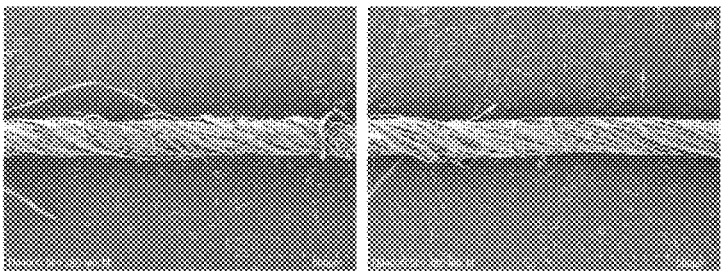

All Example 2 yarns were spun at a twist multiplier of 3.6 using roving composed of a 50% hemp and 50% cotton blend, with water droplet rates ranging from 0 ml per minute to 1.2 ml per minute. FIG. 9(*a*) shows scanning electron micrographs of the conventional ring-spun yarn (Ex. 2-1), and FIG. 9(*b*) shows scanning electron micrographs of the droplet-wet spun yarn (Ex. 2-4). Two representative SEM images of each yarn were captured under the same magnification range. A notable distinction between the two yarns is evident in terms of yarn diameter and the presence of protruding hairs from the main yarn body. Using the same raw material composition and twist multiplier, the diameter of the modified yarn (Ex. 2-4) is about 17% thinner than that of the conventional yarn (Ex 2-1), indicating that the modified yarn has a more compact structure. More obviously, the conventional yarn has more protruding fibers outside the main yarn body, contributing to yarn hairiness. Conversely, the fibers in the droplet-wet spinning yarn are well packed, with fewer protruding fibers.

Table 2 gives the effect of water drop rate on yarn quality, specifically, the tenacity, hairiness, and evenness of the yarns made at each condition. Table 2 shows that compared to conventional ring-spun yarn (Ex 2-1), all droplet-wet-spun yarns (Ex 2-2-Ex 2-6) exhibited a notable increase in yarn strength as shown in the Tenacity numbers given in gram Force per denier (gF/den). Ex 2-2, with a water dripped at a rate of 0.4 ml per minute above the top front roller, shows yarn strength increased by 17% compared to conventional spinning of Ex 2-1. The low tenacity of conventional ring spun hemp yarn (Ex 2-1) can be attributed to the uneven length and diameter of hemp fibers, as well as the high bending and twisting stiffness of dry fibers, resulting in fibers being less prone to curling and sticking together during spinning. Additionally, the surface morphology of the yarn depicted in FIG. 9(*a*) reveals noticeable gaps between fibers in ring spun hemp yarn (Ex 2-1), contributing to fiber slippage and consequent strength reduction.

TABLE 2

Effect of water drop rate on yarn quality

| Example | Water Rate (ml/min) | Tenacity (gF/den) [cv %] | Hairiness (H value) | Evenness (CVm %) |
|---|---|---|---|---|
| 2-1 | 0 | 1.07 [18.90] | 7.86 | 31.22 |
| 2-2 | 0.4 | 1.29 [17.57] | 4.36 | 32.20 |
| 2-3 | 0.6 | 1.32 [19.63] | 3.76 | 34.06 |
| 2-4 | 0.8 | 1.37 [18.97] | 3.71 | 33.86 |

TABLE 2-continued

| Effect of water drop rate on yarn quality | | | | |
|---|---|---|---|---|
| Example | Water Rate (ml/min) | Tenacity (gF/den) [cv %] | Hairiness (H value) | Evenness (CVm %) |
| 2-5 | 1.0 | 1.34 [15.83] | 3.79 | 33.82 |
| 2-6 | 1.2 | 1.38 [18.14] | 3.75 | 33.49 |

With water dripping above the front roller, the continuously rotating top front roller becomes uniformly wetted, ensuring consistent moisture within the fiber bundle between the top front roller and bottom front roller. Consequently, this reduces fiber stiffness, facilitating easier compression of softer fibers into the yarn formation zone and promoting tighter fiber cohesion. Moreover, the cohesive force of water attracts more fibers into the spinning triangle, providing a greater number of effective fibers for yarn strength, thus further enhancing yarn strength. Furthermore, as the water droplet rate steadily increases, yarn strength gradually ascends, peaking at a water droplet rate of 0.8 ml per minute (Ex 2-4), beyond which yarn strength remains relatively stable.

Table 2 shows the impact of water droplet rate on yarn hairiness. Due to the high bending stiffness, uneven fiber length, and high content of short fibers in hemp fibers, a significant number of short fibers protrude from the yarn's main body during spinning, leading to excessive hairiness, which is a notable drawback of conventional ring-spun hemp yarn. Compared to yarns produced by conventional ring spinning (Ex 2-1), all droplet-wet-spun yarns (Ex 2-2-Ex 2-6) displayed a remarkable reduction in hairiness. Notably, with water dripping at a rate of 0.4 ml per minute above the top front roller (Ex 2-2), yarn hairiness decreased by 45%. The reason for the reduction in hairiness is similar to that for the increase in yarn tenacity. During droplet-wet spinning, the continuously wetted top front roller ensures the moisture of the fiber bundle between the top front roller and bottom roller, allowing floating and short fibers on the bundle's surface to be fully integrated into the spinning triangle. Specifically, the cohesive force of water drives fibers on both sides of the fiber bundle toward the center, thereby diminishing the spinning triangle's size and facilitating fiber integration into the yarn body. Consequently, nearly all short fibers enter the spinning triangle, where wetted fibers are twisted into yarn and further embedded into the yarn body by the cohesive force of water. As a result, no visible hairiness is observed on the yarn surface. Even after drying, these short fibers remain embedded within the yarn, ensuring fiber balance during twisting. As the water droplet rate increases, yarn hairiness gradually decreases, reaching its minimum at a rate of 0.8 ml per minute, (Ex 2-4) resulting in a 53% reduction. Beyond a water droplet rate of 0.8 ml per minute, no further reduction in yarn hairiness is observed. This phenomenon occurs because the fibers' water absorption capacity reaches a threshold, preventing excess water absorption, and the fiber bundle surface cannot accommodate additional water.

Table 2 shows the effect of water droplet rate on yarn evenness. The evenness of conventional ring-spun hemp yarns exceeds 30% (Ex. 2-1), while that of typical ring-spun cotton yarns falls below 15%, primarily due to the inherent characteristics of hemp fibers. The evenness variation is expressed as the Coefficient of Variation of the mean Evenness (Cvm %). The coefficient of variation in the diameter of the hemp fibers utilized in this study was nearly 100% (Table 1). The roving employed in Example 2 comprised a blend of 50% hemp and 50% cotton fibers, resulting in considerable variation in overall fiber diameter within the roving, thereby leading to non-uniform yarn diameters at various positions.

Under droplet-wet spinning technology (Ex 2-2 to Ex 2-6), yarn evenness did not exhibit improvement and instead showed a slight deterioration. However, there was no significant disparity in yarn evenness between all droplet-wet-spun yarns (Ex 2-2 to Ex 2-6) and conventional ring-spun yarns (Ex 2-1). The minor deterioration in yarn evenness of droplet-wet spun yarns may be attributed to occasional adhesion of short fibers to the surface of the top front roller during spinning, resulting in their random incorporation into the yarn formation zone and consequent uneven yarn diameters at different positions. Nevertheless, upon observing the actual dynamic droplet-wet spinning process, it was noted that the occurrence of short fiber adhesion to the surface of the top front roller is infrequent. Considering the benefits of droplet-wet spinning in enhancing yarn evenness and substantially reducing hairiness, the slight deterioration in yarn evenness can be disregarded.

Table 3 displays the impact of water droplet rate on yarn imperfections. In comparison to conventional ring-spun yarns, droplet-wet spun yarns exhibit more thin places and thick places, particularly an increased occurrence of thick places and neps. Similar to yarn hairiness, the occasional adherence of short hemp fibers to the surface of the top front roller during water dripping contributes to the formation of thick places and neps in the yarn. However, it is notable that conventional ring-spun yarns (Ex 2-1) inherently possess a significant number of thin and thick places, which is not solely attributed to droplet-wet spinning technology. This is primarily influenced by the quality of the roving, comprising of a 50% hemp and 50% cotton blend, where the short and uneven hemp fibers lead to irregular yarn diameter

TABLE 3

| Effect of the water drop rate on yarn imperfections | | | | | | | |
|---|---|---|---|---|---|---|---|
| Ex | Thin places (−30%) | Thin places (−40%) | Thin places (−50%) | Thick places (+35%) | Thick places (+50%) | Nep (+140%) | Nep (+200%) |
| 2-1 | 13061.67 | 7828.33 | 3388.33 | 6636.67 | 4106.67 | 12223.33 | 5738.33 |
| 2-2 | 13861.67 | 8880.00 | 4420.00 | 6978.33 | 4366.67 | 14503.33 | 7630.00 |
| 2-3 | 13911.67 | 9370.00 | 4820.00 | 7493.33 | 4883.33 | 14025.00 | 7341.67 |
| 2-4 | 13893.33 | 9285.00 | 4990.00 | 7475.00 | 4766.67 | 14023.33 | 7330.00 |
| 2-5 | 14171.67 | 9475.00 | 4881.67 | 7410.00 | 4863.33 | 14093.33 | 7393.33 |
| 2-6 | 13992.22 | 9376.67 | 4897.22 | 7459.44 | 4837.78 | 14047.22 | 7355.00 |

Example 3—Effect of Hemp Content on Yarn Quality

All Example 3 yarns were spun with twist multiplier of 3.6, with a water droplet rate of 0.8 ml per minute. Rovings comprising five different hemp and cotton fiber blends were utilized, including compositions of 50% hemp/50% cotton (Ex 3-1), 37% hemp/63% cotton (Ex 3-2), 25% hemp/75% cotton (Ex 3-3), 12% hemp/88% cotton (Ex 3-4), and 100% cotton (Ex 3-5).

Table 4 shows the effect of hemp content on yarn tenacity. The Fiber Portion in the Roving decreases from 50% hemp in Ex. 3-1 to 0% hemp in Ex. 3-5. A lower proportion of hemp fibers in the roving corresponds to decreased yarn strength. Although the hemp fiber bundles tested displayed notably higher strength compared to cotton fiber bundles, this disparity does not imply that the supplied hemp fibers possess a greater average strength than cotton fibers. During the fiber bundle strength testing process, the initial combing of the hemp fiber bundle typically moves most short fibers, leaving behind longer, thicker fibers that may be bonded by pectin residues. Consequently, the measured strength of the hemp fiber bundle reflects the maximum strength of the hemp fibers, rendering the measured results ineffective for comparing the average strength of fibers. In contrast, cotton fibers are more uniform in diameter, length, and strength. As previously mentioned, hemp fibers possess high bending stiffness, rendering interlocking difficult. Therefore, yarns with higher hemp content may lack sufficient fiber loading to withstand external forces. Conversely, cotton fibers have lower bending stiffness and are curly, resulting in tighter cohesion between fibers within the yarn. When subjected to external forces, a yarn with a tighter structure is less prone to breakage due to fiber slippage. Consequently, yarn tenacity tends to increase as the proportion of hemp fibers decreases, and cotton fibers become the dominant component.

TABLE 4

Effect of hemp content on yarn tenacity

| Example | Fiber Portion n Roving | Tenacity (gF/den) [cv %] Conventional | Tenacity (gF/den) [cv %] 0.8 ml water/min |
|---|---|---|---|
| 3-1 | 50% Hemp/ 50% Cotton | 1.07 [18.90] | 1.37 [18.97] |
| 3-2 | 37% Hemp/ 63% Cotton | 1.12 [15.40] | 1.47 [17.57] |
| 3-3 | 25% Hemp/ 75% Cotton | 1.23 [13.83] | 1.47 [14.30] |
| 3-4 | 12% Hemp/ 88% Cotton | 1.35 [9.80] | 1.65 [13.83] |
| 3-5 | 100% Cotton | 1.53 [11.83] | 1.71 [16.53] |

However, it is noteworthy that droplet-wet spinning technology can effectively compensate for this drawback of hemp yarns. Across all blending ratios (Ex 3-1 to Ex 3-5), droplet-wet spun yarns demonstrated superior strength compared to conventional ring-spun yarns, with statistically significant differences. Furthermore, the higher the hemp content in the yarn, the more pronounced the advantage of droplet-wet spinning technology in enhancing yarn strength, owing to the elongated cavities and numerous cracks and small holes longitudinally distributed on the fiber surface, rendering hemp fibers highly absorbent. For rovings with a 50% hemp and 50% cotton blend (Ex 3-1), droplet-wet spun yarn strength increased by 22% compared to the conventional spun yarn. As the hemp content decreased progressively, the increment in droplet-wet spun yarn strength became less prominent. For rovings with a 12% hemp and 88% cotton blend (Ex 3-4), droplet-wet spun yarn strength increased by 18%, while for rovings with 100% cotton (Ex 3-5), droplet-wet spun yarn strength only increased by 11%. It is evident that droplet-wet spinning technology effectively enhances the tenacity of hemp yarns, and it does not yield significant advantages for cotton yarns.

Table 5 depicts the influence of hemp content on yarn hairiness. Similar to yarn tenacity, a decrease in hemp content in conventional ring-spun yarns leads to more uniform fiber length and diameter, tighter fiber cohesion, and reduced yarn hairiness, with 100% cotton yarn (Ex 3-5) displaying the least hairiness. Across rovings with varying blending ratios, all droplet-wet spun yarns exhibited a notable reduction in hairiness compared to ring-spun yarns, with statistically significant differences observed. Furthermore, the higher the hemp fiber content, the more pronounced the advantage of droplet-wet spinning technology in reducing yarn hairiness. Droplet-wet spun yarn hairiness decreased for Ex 3-1 to Ex 3-5 by 53%, 51%, 48%, 43%, and 38%, respectively, for four different hemp content ratios and 100% cotton yarn. Particularly noteworthy is that relative to ring-spun 100% cotton yarn (Ex 3-5), droplet-wet spun yarn with a 50% hemp and 50% cotton blend (Ex 3-1) exhibited a 41% reduction in hairiness. This underscores the substantial benefits of droplet-wet spinning technology in enhancing hemp yarn quality, as droplet-wet spun yarn incorporating half hemp fibers exhibits significantly reduced hairiness compared to pure cotton yarn, effectively addressing the issue of excessive hairiness in hemp yarns.

TABLE 5

Effect of Hemp Content on Hairiness

| Example | Fiber Portion n Roving | Hairiness (H value) Conventional | Hairiness (H value) 0.8 ml water/min |
|---|---|---|---|
| 3-1 | 50% Hemp/ 50% Cotton | 7.86 | 3.71 |
| 3-2 | 37% Hemp/ 63% Cotton | 7.48 | 3.70 |
| 3-3 | 25% Hemp/ 75% Cotton | 7.13 | 3.70 |
| 3-4 | 12% Hemp/ 88% Cotton | 6.44 | 3.67 |
| 3-5 | 100% Cotton | 6.26 | 3.87 |

Table 6 shows the impact of hemp content on yarn evenness. As the proportion of hemp fibers increases, both conventional ring-spun and droplet-wet spun yarns exhibit a deterioration in evenness. Yarn evenness is directly associated with the uniformity of fiber diameter and length. Given the coefficient of variation in hemp fiber diameter approaches 100%, significant variations in fiber diameter occur, resulting in poorer yarn evenness with higher hemp fiber content. Although droplet-wet spinning leads to a slight deterioration in yarn evenness compared to conventional ring spinning, there is no statistically significant difference between the evenness of droplet-wet-spun and conventional ring-spun yarns. Additionally, as the hemp fiber content decreases, the influence of droplet-wet spinning technology on yarn evenness diminishes. Droplet-wet spun yarn evenness increases by 7.8%, 5.2%, 3.6%, 2.9%, and 2%, respectively, for four different hemp content ratios and 100% cotton yarn compared to conventional ring-spun yarn. This implies that during the droplet-wet spinning process, shorter hemp fibers are more prone to adhere to the moistened top front roller due to the unevenness of hemp fibers, subsequently entering the spinning triangle as fiber clusters and resulting in worse yarn evenness. Considering that there is no significant deterioration in the evenness of all droplet-wet spun yarns and given the advantages of droplet-wet spun yarns in strength and hairiness, the slight deterioration in evenness can be overlooked.

TABLE 6

Effect of Hemp Content on Evenness

| Example | Fiber Portion n Roving | Evenness (CVm %) Conventional | Evenness (CVm %) 0.8 ml water/min |
|---|---|---|---|
| 3-1 | 50% Hemp/ 50% Cotton | 31.22 | 33.86 |
| 3-2 | 37% Hemp/ 63% Cotton | 29.38 | 30.99 |
| 3-3 | 25% Hemp/ 75% Cotton | 27.79 | 28.83 |
| 3-4 | 12% Hemp/ 88% Cotton | 24.88 | 25.62 |
| 3-5 | 100% Cotton | 22.98 | 23.44 |

Table 7 demonstrates the impact of the blend ratio of hemp content within roving on yarn imperfections. As the hemp content increases, both conventional ring-spun yarns and droplet-wet spun yarns exhibit more imperfections. This corresponds with the trend of yarn evenness discussed earlier, where the uneven diameter of hemp fibers leads to irregular yarn diameter. In contrast to the exaggerated imperfections observed in 50% hemp and 50% cotton yarn (Ex 3-1), 100% cotton yarn (Ex 3-5) displays normal thin and thick places. Across all blends of hemp and cotton, droplet-wet spun yarns show increased imperfections compared to conventional ring-spun yarns, as droplet-wet spinning technology results in more fiber tufts attached to the surface of the front roller, which then enter the yarn.

TABLE 7

Effect of the hemp content on yarn imperfection

| Ex | | Thin places (−30%) | Thin places (−40%) | Thin places (−50%) | Thick places (+35%) | Thick places (+50%) | Nep (+140%) | Nep (+200%) |
|---|---|---|---|---|---|---|---|---|
| 3-1 | Conv | 13061.67 | 7828.33 | 3388.33 | 6636.67 | 4106.67 | 12223.33 | 5738.33 |
| | Wet | 13893.33 | 9285.00 | 4990.00 | 7475.00 | 4766.67 | 14023.33 | 7330.00 |
| 3-2 | Conv | 12218.33 | 6870.00 | 2645.00 | 6216.67 | 3661.67 | 10445.00 | 4693.33 |
| | Wet | 12785.00 | 7751.67 | 3408.33 | 6950.00 | 4253.33 | 11903.33 | 5763.33 |
| 3-3 | Conv | 11013.33 | 5701.67 | 1948.33 | 5780.00 | 3235.00 | 8920.00 | 3760.00 |
| | Wet | 11480.00 | 6401.67 | 2491.67 | 6200.00 | 3456.67 | 9918.33 | 4270.00 |
| 3-4 | Conv | 8925.00 | 3858.33 | 1011.67 | 4805.00 | 2436.67 | 6568.33 | 2305.00 |
| | Wet | 9433.33 | 4326.67 | 1276.67 | 5085.00 | 2526.67 | 7301.67 | 2838.33 |
| 3-5 | Conv | 7475.00 | 2720.00 | 505.00 | 4070.00 | 1816.67 | 4028.33 | 1168.33 |
| | Wet | 8103.33 | 3315.00 | 741.67 | 4466.67 | 2030.00 | 4758.33 | 1583.33 |

Example 4—Effect of Twist Multiplier on Yarn Quality

For Example 4, the roving comprised 50% hemp and 50% cotton, and the water droplet rate was 0.8 ml per minute. Five levels of yarn twist multipliers commonly used in knitted and woven fabrics were employed: 3.6 (Ex 4-1), 3.8 (Ex 4-2), 4.0 (Ex 4-3), 4.2 (Ex 4-4), and 4.4 (Ex 4-5). Yarn twist is recognized as a critical factor influencing yarn quality, with higher twists generally resulting in better performance. However, increased yarn twist correlates with higher electricity consumption, and reducing twist offers an effective means to decrease energy consumption during production from an environmental perspective.

Table 8 shows the impact of yarn twist on yarn tenacity. In conventional ring spinning, as the twist multiplier increases from 3.6 to above 4.0, hemp yarn tenacity notably improves. For droplet-wet-spun hemp yarns, tenacity gradually increases when twist multiplier increases from 3.6 to 4.0 (Ex 4-1-Ex 4-3), in line with general trends. However, when the twist multiplier surpasses 4.0 (Ex 4-4 and Ex 4-5), yarn tenacity gradually decreases with increasing twist multiplier. This is because higher twist multipliers subject the fibers in the yarn formation zone to greater tension. Additionally, at each twist multiplier, the tenacity of droplet-wet-spun hemp yarn is higher than that of conventional ring-spun yarn, particularly in the medium to low twist multiplier range (3.6-4.0), with statistically significant differences in tenacity between droplet-wet-spun and ring-spun yarns. At twist multipliers of 3.6 (Ex 4-1), 3.8 (Ex 4-2), and 4.0 (Ex 4-3), droplet-wet-spun hemp yarn exhibited increases in tenacity by 21.9%, 26.4%, and 14.9%, respectively, compared to conventional ring-spun yarn. Notably, at a twist multiplier of 3.6 (Ex 4-1), droplet-wet-spun hemp yarn demonstrated a 12.4% higher tenacity than conventional ring-spun hemp yarn at a twist multiplier of 4.4 (Ex 4-5). According to the spinning electricity consumption formula, a reduction of a yarn twist multiplier form 4.4 to 3.6 leads to a 18.1% reduction in electricity consumption.

TABLE 8

Effect of Twist Multiplier on Tenacity

| Example | Twist Multiplier | Tenacity (gF/den) [cv %] Conventional | Tenacity (gF/den) [cv %] 0.8 ml water/min |
|---|---|---|---|
| 4-1 | 3.6 | 1.07 [18.90] | 1.37 [18.97] |

TABLE 8-continued

Effect of Twist Multiplier on Tenacity

| Example | Twist Multiplier | Tenacity (gF/den) [cv %] Conventional | Tenacity (gF/den) [cv %] 0.8 ml water/min |
|---|---|---|---|
| 4-2 | 3.8 | 1.03 [13.60] | 1.40 [16.63] |
| 4-3 | 4.0 | 1.20 [18.50] | 1.41 [17.03] |
| 4-4 | 4.2 | 1.23 [15.55] | 1.33 [25.00] |
| 4-5 | 4.4 | 1.20 [17.57] | 1.31 [19.53] |

Table 9 illustrates the impact of yarn twist on yarn hairiness. In both conventional ring-spun and droplet-wet spun yarns, there is an overall trend of reduced yarn hairiness with increasing twist multiplier. However, the increase in twist multiplier does not notably enhance the hemp yarn hairiness, which may be attributed to the stiffness, difficulty in interlocking, and non-uniformity of hemp fibers. The inserted twist may not effectively facilitate the insertion of more fibers into the yarn body during spinning. Furthermore, it is apparent that at each twist multiplier, droplet-wet-spun hemp yarn exhibits significantly lower hairiness compared to conventional ring-spun yarn. Across the five twist multipliers of Ex 4-1-Ex 4-5, droplet-wet-spun hemp yarn shows reductions in hairiness of 52.8%, 53.2%, 55.1%, 53.2%, and 53.6%, respectively, compared to conventional ring-spun yarn. Additionally, droplet-wet spun yarn demonstrates a halving of hairiness compared to ring-spun yarn at any twist multiplier. This suggests that droplet-wet spinning technology has a more pronounced effect on reducing hairiness compared to increasing twist to enhance hemp yarn hairiness. Under droplet-wet spinning technology, hemp yarn exhibits minimal hairiness, regardless of whether it is at low or high twist multipliers.

TABLE 9

Effect of Twist Multiplier on Hairiness

| Example | Twist Multiplier | Hairiness (H value) Conventional | Hairiness (H value) 0.8 ml water/min |
|---|---|---|---|
| 4-1 | 3.6 | 7.86 | 3.71 |
| 4-2 | 3.8 | 7.78 | 3.64 |
| 4-3 | 4.0 | 7.78 | 3.49 |
| 4-4 | 4.2 | 7.30 | 3.42 |
| 4-5 | 4.4 | 7.35 | 3.41 |

Table 10 shows the impact of yarn twist on yarn evenness. As yarn twist increases, the changes in evenness for both conventional ring-spun and droplet-wet-spun hemp yarns are not significant, and the evenness of both yarn types remains relatively poor, influenced by the inherent characteristics of hemp fibers. Despite a slight inferiority in evenness observed in droplet-wet-spun hemp yarn compared to conventional ring-spun yarn at each twist multiplier (Ex 4-1-Ex 4-5), the difference is not statistically significant. As previously analyzed, the slight deterioration in evenness during droplet-wet spinning is attributed to the adhesion of short hemp fibers to the moistened top front roller before entering the spinning triangle as fiber clusters, thereby worsening yarn evenness.

TABLE 10

Effect of Twist Multiplier on Evenness

| Example | Twist Multiplier | Evenness (CVm %) Conventional | Evenness (CVm %) 0.8 ml water/min |
|---|---|---|---|
| 4-1 | 3.6 | 31.22 | 33.86 |
| 4-2 | 3.8 | 31.51 | 33.52 |
| 4-3 | 4.0 | 31.82 | 33.47 |
| 4-4 | 4.2 | 32.31 | 33.49 |
| 4-5 | 4.4 | 31.96 | 33.43 |

Table 11 displays the effect of twist multiplier on yarn imperfections. The imperfections in both conventional ring-spun and droplet-wet spun yarns do not show significant changes with varying twist multipliers. There is considerable randomness in the variation of yarn imperfections with increasing twist. Furthermore, droplet-wet spun yarns demonstrate more imperfections compared to traditional ring-spun yarns at each twist multiplier. Particularly, at lower twist levels, the increase in imperfections in droplet-wet spun yarns is more pronounced. This phenomenon may be attributed to the shorter fiber migration trajectory within the spinning triangle at lower twist multipliers. When short hemp fibers attached to the wet front roller enter the yarn in the form of fiber tufts, they lack sufficient opportunity to embed within the yarn due to the shorter migration trajectory, leading to their adhesion on the surface of the yarn and subsequent imperfection.

TABLE 11

Effect of the twist multiplier on yarn imperfection

| Ex | | Thin places (−30%) | Thin places (−40%) | Thin places (−50%) | Thick places (+35%) | Thick places (+50%) | Nep (+140%) | Nep (+200%) |
|---|---|---|---|---|---|---|---|---|
| 4-1 | Conv | 13061.67 | 7828.33 | 3388.33 | 6636.67 | 4106.67 | 12223.33 | 5738.33 |
| | Wet | 13893.33 | 9285.00 | 4990.00 | 7475.00 | 4766.67 | 14023.33 | 7330.00 |
| 4-2 | Conv | 13585.00 | 8960.00 | 4545.00 | 6905.00 | 4105.00 | 12795.00 | 6175.00 |
| | Wet | 13835.00 | 9166.67 | 4653.33 | 7445.00 | 4780.00 | 13433.33 | 6958.33 |
| 4-3 | Conv | 13346.67 | 8316.67 | 3925.00 | 6801.67 | 4180.00 | 12530.00 | 6041.67 |
| | Wet | 13571.67 | 8983.33 | 4721.67 | 7295.00 | 4718.33 | 13375.00 | 6943.33 |
| 4-4 | Conv | 13323.33 | 8241.67 | 3643.33 | 6778.33 | 4171.67 | 12521.67 | 6185.00 |
| | Wet | 13935.00 | 9068.33 | 4696.67 | 7411.67 | 4753.33 | 13623.33 | 7141.67 |
| 4-5 | Conv | 13170.00 | 8161.67 | 3733.33 | 6850.00 | 4220.00 | 12886.67 | 6335.00 |
| | Wet | 13751.67 | 9196.67 | 4843.33 | 7378.33 | 4718.33 | 13248.33 | 6790.00 |

Example 5—Knitted Fabric With Conventional Ring and Droplet-Wet Spun Yarn

Yarn was spun at a twist multiplier of 3.6 using roving composed of a 50% hemp and 50% cotton blend and with a water droplet rate of 0.8 ml/min. Knitted fabrics were produced on a Masden lab knitting machine using the plied yarns. The surface morphology, fabric weight, fabric thickness, fabric density, bursting strength, and pilling performance of the two fabrics were evaluated.

Figure 10A:
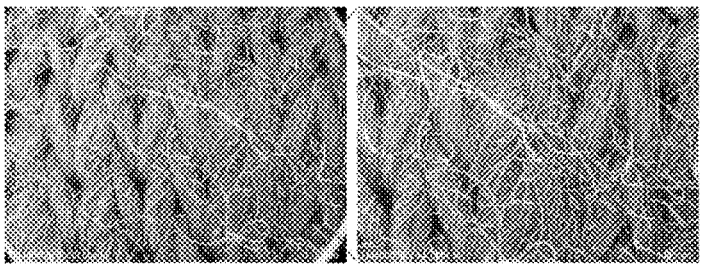
Prior Art FIG. 10(a)
FIG. 10(*a*) are scanning electron micrographs of a knitted fabric made with conventional ring-spun yarn and FIG. 10(*b*) are scanning electron micrographs of a knitted fabric made with a droplet wet spun yarn.
Figure 10B:
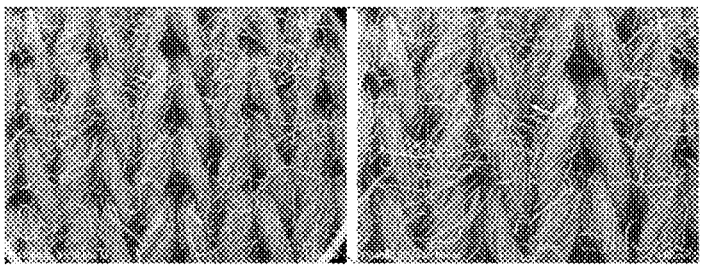

FIG. 10(*a*) shows representative SEM images of knitted fabric made with conventional ring spun yarn and FIG. 10(*b*) shows representative SEM images of knitted fabric made with droplet-wet spun yarn. Each fabric was captured under two magnification ranges. It is evident that the fabric surface knitted with conventional ring-spun plied yarn exhibits more protruding hairiness, including short protrusions from the yarn, as well as numerous randomly arranged fibers on the fabric surface. Although the fabric knitted with droplet-wet spun yarn also has some protruding yarn hairiness on its surface, this is due to the friction on the yarn surface during the knitting process, which pulls out some short fibers from the yarn. The quantity and uniformity of hairs on the fabric surface directly affect the fabric's resistance to pilling. It can also be observed that the fabric knitted with droplet-wet spun yarn has a more uniform structure, displaying a clear structure, whereas the fabric knitted with conventional ring-spun yarn exhibits uneven fabric structure due to the loose yarn structure and entanglement of hairiness.

The results of the fabric weight, fabric thickness, fabric density, bursting strength, and pilling resistance performance of fabrics knitted using ring-spun and droplet-wet-spun hemp yarn are detailed in Table 12. The two fabrics have similar fabric weights. Knitted fabric made from droplet-wet spun yarn is slightly thinner than that made from conventional ring-spun yarn, with a slightly higher fabric density. This is attributed to droplet-wet spun yarn having fewer surface hairs than conventional yarn and a tighter yarn structure, resulting in a finer diameter. The average bursting strength of hemp fabric knitted with droplet-wet spun yarn is approximately 8% higher than that of fabric knitted with conventional ring-spun yarn, with the minimum bursting strength increasing by nearly 10%. This represents a significant improvement, suggesting that under the same spinning materials and twist multipliers, droplet-wet spinning technology enables the production of hemp yarn capable of yielding fabrics with superior bursting strength, thus enhancing the overall performance of hemp textiles.

TABLE 12

Comparison of bursting strength of knitted fabric made with different yarns

| | Fabric weight ($g/m^3$) [cv %] | Fabric thickness (mm) [cv %] | Wales/ 5 cm | Courses/ 5 cm | Bursting strength mean (psi) [cv %] | Bursting strength max (psi) | Bursting strength min (psi) | Pilling grade |
|---|---|---|---|---|---|---|---|---|
| Fabric knitted with conv-spun yarn | 178.37 [4.15] | 0.67 [2.46] | 43 | 57 | 64.5 [9.86] | 74.62 | 58.67 | 1.33 |
| Fabric knitted with droplet-wet spun yarn | 178.66 [2.26] | 0.62 [1.87] | 47 | 59 | 70.07 [7.64] | 76.24 | 64.84 | 2.3 |

Fabric pilling refers to the formation of tangled fiber balls on the surface of the fabric, adhering to it and causing an unsightly appearance. This phenomenon arises from loose fibers becoming entangled and protruding during abrasion and washing processes. With continued friction, these loose fibers aggregate to form fibrous balls, adhering to the fabric. Pilling grades range from 1 to 5, with higher values indicating better fabric performance. Notably, after 3000 cycles of abrasion, the pilling grade of hemp fabric knitted from droplet-wet spun yarn is 2.3, an improvement of one grade compared to that knitted from conventional ring-spun yarn.

Example 6—Effect of Drop-Wet Spinning Across Different Materials

All Example 6 Ne 21 yarns were spun on a commercial sample ring spinning machine without and with the help of DWS (droplet-wet spinning). All Example 6 yarns were spun with twist multiplier of 3.6, with a water droplet rate of 0.8 ml per minute. Rovings comprising three different compositions were utilized, including compositions 100% cotton (Ex 6-1), 75% cotton/25% hemp/(Ex 6-2), 75% nylon/25% hemp (Ex 6-3). Table 13 gives the skein strength and hairiness index for each composition under conventional spinning and droplet-wet spinning conditions.

Skein strength represents the total tensile strength of a yarn assembly and is commonly used to assess yarn quality in bulk form. To measure skein strength, the yarn is wound into a standardized loop and mounted on a tensile testing machine. The looped ends are placed over two hooks or clamps, which are pulled apart at a constant rate until the yarn breaks. The maximum force recorded during this process is the skein breaking strength, typically reported in Newtons or grams-force. This value can be converted to centinewtons per tex (cN/tex) by accounting for the total linear density of the skein, providing an average strength per unit fineness. However, since the skein test method differs from standard single yarn tenacity testing, the resulting values are not directly comparable. Still, when tested under the same conditions, skein strength values are useful for relative comparisons—where higher values indicate stronger yarns.

TABLE 13

Comparative experimental data

| Material | Spinning method | Yarn count | Skein Strength (cN/tex) [cv %] | Hairiness Uster Index [cv %] |
|---|---|---|---|---|
| Cotton | conventional | Ne 21 | 32.42 [0.45%] | 5.54 [20.58%] |

TABLE 13-continued

| Comparative experimental data | | | | |
|---|---|---|---|---|
| Material | Spinning method | Yarn count | Skein Strength (cN/tex) [cv %] | Hairiness Uster Index [cv %] |
| | Drop-wet | | 39.48 [4.2%] | 3.26 [23.31%] |
| Cotton 75%/ Hemp 25% | Conventional | | 24.11 [1.26%] | 8.35 [28.02%] |
| | Drop-wet | | 28.28 [2.48%] | 3.47 [35.45%] |
| Nylon 75%/ Hemp 25% | Conventional | | 23.65 [4.09%] | 7.68 [29.69%] |
| | Drop-wet | | 28.10 [3.67%] | 5.59 [29.70%] |

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A method of producing yarn, the method comprising: adding a liquid to a roving fiber directly before a nip formed by a top front rollers and a bottom front roller or near a top of the top front roller of a ring spinning apparatus to produce a liquid-exposed roving fiber, wherein the liquid-exposed roving fiber produces a liquid-impacted spinning triangle of the roving fiber leaving the nip, and wherein the liquid is added at a flowrate ranging between 0.01 liter/hour and 1 liter/hour.

2. The method of claim 1, wherein the roving fiber comprises a hydrophilic fiber;

or wherein the roving fiber comprises a hydrophilic fiber, and wherein the hydrophilic fiber comprises cotton, bamboo, linen, hemp, viscose, rayon, modal, Tencel and/or wool.

3. The method of claim 1, wherein the roving fiber comprises from 0 wt. % to 100 wt. % cotton and from 0 wt. % to 100 wt. % hemp.

4. The method of claim 1, wherein the liquid comprises water, ethyl alcohol, soap, sodium carboxymethyl cellulose, polyacrylamide, and/or polyvinyl alcohol.

5. The method of claim 1, wherein a temperature of the liquid ranges from 20° C. to 90° C.

6. The method of claim 1, wherein the method further comprises measuring a speed of the top front rollers or the bottom front roller and adjusting the flowrate of the liquid.

7. The method of claim 1, wherein the liquid is added through a nozzle and the nozzle has a pressure ranging from 0.1 MPa to 3 MPa.

8. The method of claim 1, wherein a twist multiplier level ranges from 2.5 to 5.5.

9. The method of claim 1, wherein the method further comprises: an addition of a filament to the ring spinning apparatus at back rollers or the nip.

10. The method of claim 9, wherein the filament comprises spandex.

11. A method of producing yarn, the method comprising: adding a liquid to a roving fiber directly before a nip in formed by a top front rollers and a bottom front roller or near a top of the top front roller of a ring spinning apparatus to produce a liquid-exposed roving fiber, wherein the liquid-exposed roving fiber produces a liquid-impacted spinning triangle of the roving fiber leaving the nip, wherein the roving fiber comprises cotton and/or hemp, wherein a twist multiplier level ranges from 2.5 to 5.5.

12. The method of claim 11, wherein the liquid comprises water, wherein the liquid is added at a flowrate ranging between 0.01 liter/hour and 1 liter/hour, and wherein the method further comprises measuring a speed of the top front rollers or the bottom front roller and adjusting the flowrate of the liquid.

13. The method of claim 11, wherein the liquid is added through a nozzle and the nozzle has a pressure ranging from 0.1 MPa to 3 MPa.

14. The method of claim 11, wherein the method further comprises: an addition of a filament to the ring spinning apparatus at a back rollers or the nip, wherein the filament comprises spandex.

15. The method of claim 11, wherein a temperature of the liquid ranges from 20° C. to 90° C.

16. The method of claim 11, wherein the roving fiber comprises 0 wt. % to 100 wt. % cotton and 0 wt. % to 50 wt. % hemp.

* * * * *